United States Patent [19]

Wilson

[11] 3,955,391

[45] May 11, 1976

[54] ROLLING MILL

[75] Inventor: Alexander Ian Wilson, Sheffield, England

[73] Assignee: Hille Engineering Company Limited, Yorkshire, England

[22] Filed: June 27, 1975

[21] Appl. No.: 591,003

[30] Foreign Application Priority Data

June 27, 1974 United Kingdom ..... 28576/74

[52] U.S. Cl. ..... 72/190; 72/240; 72/406

[51] Int. Cl.[2] ..... B21B 13/20

[58] Field of Search ..... 72/189, 190, 197, 406, 72/407, 408, 240

[56] References Cited

UNITED STATES PATENTS 3,439,519 4/1967 Gerding ..... 72/190

*Primary Examiner*—Lowell A. Larson

*Attorney, Agent, or Firm*—Brisebois & Kruger

[57] ABSTRACT

A rod or bar mill stand has two work-roll carrying mountings which are pivoted together on one side of the plane containing the roll axes and which are individually connected to synchronously driven eccentrices. The eccentric drives for the roll mountings, together with the pivotal connection, cause each of the roll axes to follow an eliptical or oval path, such that each roll approaches the pass line to reduce the work, over a part only of the path. The work rolls are driven about their own axes to induce forward movement of the work.

5 Claims, 6 Drawing Figures

ROLLING MILL

This invention relates to rolling mills and is particularly concerned with the construction of a rolling mill stand designed to give a high reduction, with intermittent contact with the workpiece. It is therefore applicable to the first stand of a continuous multi-stand mill for rolling rod and bar from billets, which are introduced into the stand at high temperature.

There is a continuous requirement to produce rod in larger and larger coil weights; in other words, there is a demand to increase the amount of rod rolled from a single billet. That objective can be achieved by increasing the length of the billet, or by increasing the cross-sectional area of the billet. The first expedient necessitates the provision of longer furnaces and corresponding increases in capital cost.

The other expedient of increasing the cross-sectional area of the billet is also faced with difficulties. The ratio of the speed at which the work enters the first stand of the rod mill train to the speed at which the final rod leaves the last stand is directly proportional to the overall reduction effected in the mill. Therefore, for a given cross-sectional area of the final rod, an increase in the cross-sectional area of the billet can be accommodated only by increasing the speed at which the rod leaves the final stand, or by decreasing the speed at which the billet enters the first stand. Much work has been done in designing finishing rod mill stands to operate at higher and higher speeds, and a limit has been reached with present designs. Similarly, the speed of operation of the first, or roughing, stand has been progressively reduced and a limit of approximately 0.05 m/sec. has been achieved for the entry speed into the first stand; below that figure, there is a very real danger of fire cracking of the rolls occurring.

The high speed of delivery of rod from the final stand under modern practice is also accompanied with further problems. Special expendients must be adopted to coil rod at high speed and this, in turn involves expensive and sophisticated equipment.

Efforts have therefore been directed towards obtaining a first stand capable of rolling billets at extremely low work speeds. The achievement of such low speeds would enable greater coil weights to be rolled, if the present high speeds from the last stand are tolerated, by increasing the cross-sectional area of the billets. Alternatively, low speed rolling in the first stand, without increase in the cross-sectional area of the billet, enables a lower exit speed from the final stand to be achieved, with a reduction in the complexity of the coiler and other delivery equipment. The relatively low exit speed further facilitates controlled cooling of the rolled rod.

In U.S. Pat. No. 3,908,423 there is described a rolling mill stand, in which the work rolls are so constrained that their axes move in closed paths, so that the rolls engage and reduce the work during a part only of each cycle.

The present invention provides a particular stand construction, specially suited for that purpose.

According to the present invention a rod or bar mill stand comprises a pair of roll mountings; a pair of co-operative work rolls each carried by a different roll mounting; a pivotal connection between the mountings on one side of the plane through the axes of the work rolls, permitting relative pivoting of the mounting about an axis parallel to the roll axes; for each mounting, support means pivotally connected to a part of the mounting on the other side of the roll axes plane for causing cyclic movement of that part, so that the axis of the work roll associated with the support means is constrained to move in a closed path which, over a limited part, approaches the passline of the stand; and means for driving the rolls about their axes.

The mill stand of the invention has the advantage over that described and illustrated in the above application that the larger part of the separating force applied by the workpiece to the rolls is absorbed by the pivotal connection between the roll mountings, the support means then being subject to less load due to the separating force compared with the stand of the previous application.

A second aspect of the present invention resides in a rod or bar mill stand for giving a primary reduction to a workpiece, the stand comprising a housing; a pair of roll mountings; a pair of co-operative work rolls each carried by a different mounting; a pivotal connection, independent of the housing, between the mountings on one side of the plane through the axes of the work rolls, permitting relative pivoting of the mountings about an axis parallel to the roll axes; drive means pivotally connecting each of the mountings to the housing on the other side of the roll axes plane, the drive means being such that the work roll axes are constrained to move synchronously in closed paths which, over a limited part, approach the passline so that, in use, the rolls intermittently and simultaneously engage the opposite sides of a workpiece between the rolls; and means for driving each work roll about its axis to give a peripheral speed differing from the peripheral speed of the roll surfaces due to the driving means for the mounting, such that the workpiece is urged by the work rolls in the feed direction.

Preferably, the drive means for each roll mounting includes an eccentric journalled in the housing and pivotally supporting the roll mounting. The eccentric may be driven by any suitable prime mover, such as an electric or hydraulic motor, a hydraulic cylinder or a screw jack.

The invention will be more readily understood by way of example from the following description of a rolling mill stand in accordance therewith, reference being made to the accompanying drawings, in which.

Figure 1:
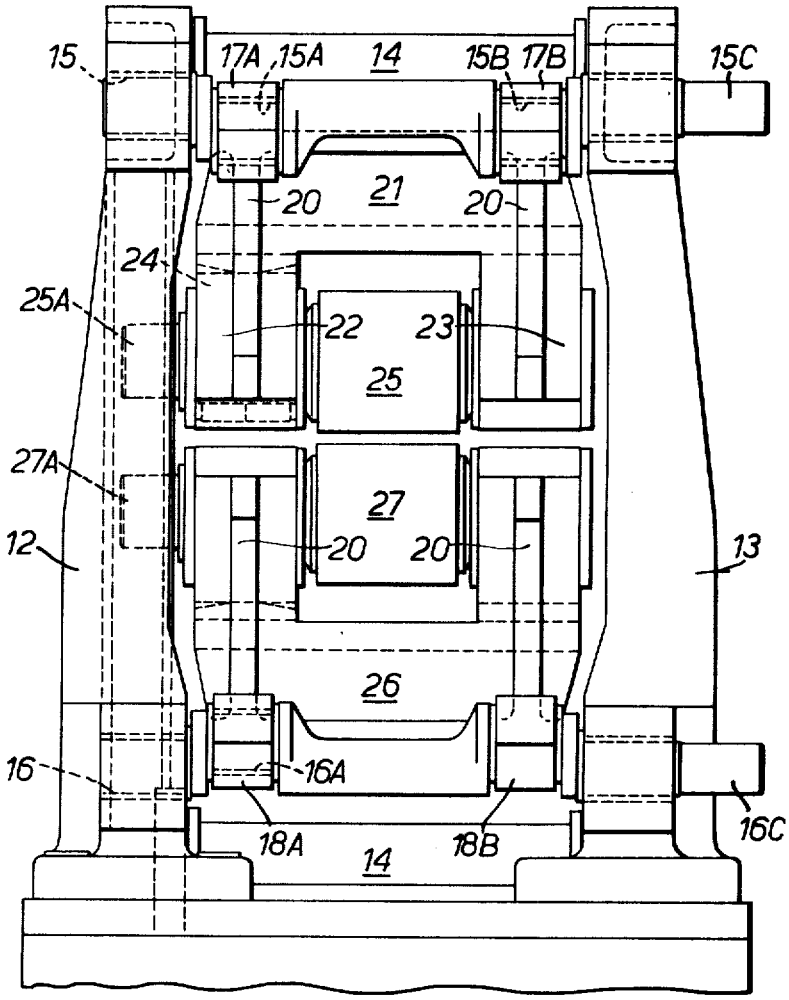
FIG. 1 is a side view of the stand.

FIGS. 3A – D illustrate the operation of the stand.

The roll stand has a housing, which consists of two, spaced, uprights 12, 13 which are connected together by ties 14.

Two crank shafts 15, 16 are journalled at their ends in bearings in the uprights 12, 13 and each crank shaft has two cranks 15A, 15B and 16A, 16B. In turn, each of the cranks carries a bearing block 17A, 17B and 18A, 18B, which thus constitute eccentries.

The bearing blocks 17A, 17B are secured to vertical plates 20, which are integral with a roll mounting 21 having two spaced downwardly extending pairs of parallel legs 22, 23. An upper work roll 25 has chocks 24, each of which is received between, and secured to, one of the pairs of legs 22, 23.

A similar roll mounting 26 is similarly carried by the bearing blocks 18A, 18B and supports a co-operating roll 27 having its axis parallel to that of the roll 25. The work rolls together act on and reduce the work.

The two roll mountings 21, 26 are pivotally connected together about an axis parallel to the axes of the rolls and on that side of the plane through the roll axes opposite to the crank shafts 15, 16. The pivotal connection is constituted by a pair of knuckle joints, each of which is formed by an integral, bifurcated, extensions 30 (FIG. 2) of one of the pair of legs 22, 23 of the upper roll mounting 21, and a lug 32 formed as an upward extension of one of the corresponding pair of legs of the lower roll mounting 26. In each joint, the lug 32 is received between the corresponding extensions 30 and is pivoted to those extensions by a hinge pin 33. The two pins 33 are coaxial and the axes lie on the passline between the work rolls 25, 27 and are parallel to the axes of those rolls. As will be appreciated, the knuckle joints are located on opposite sides of the rolls 25, 27 and do not impede the movement of the work through the stand.

Figure 2:
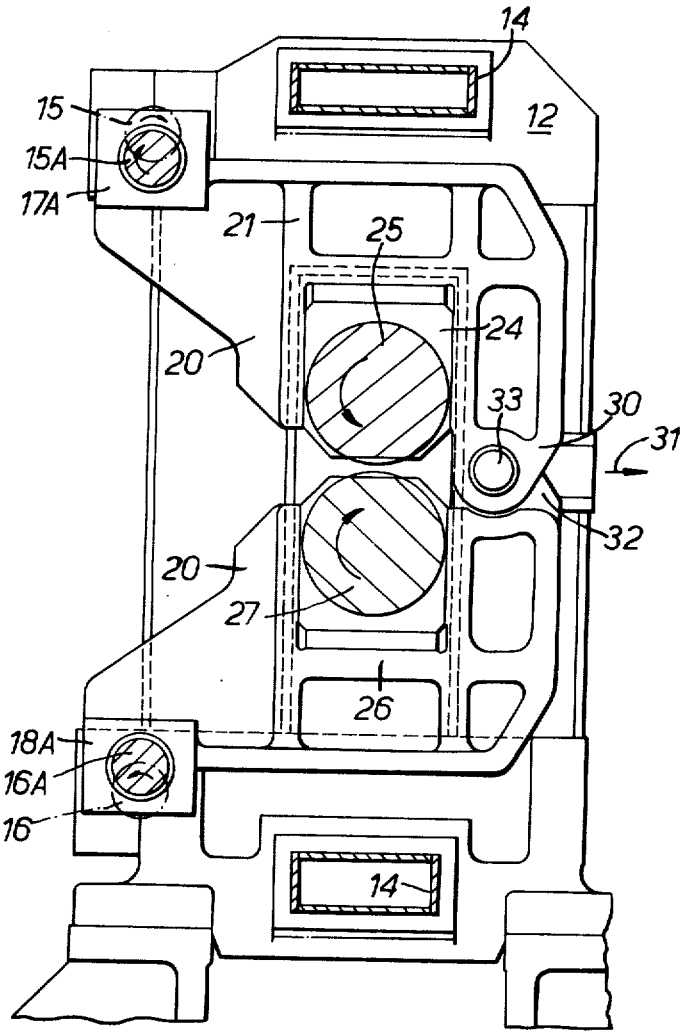
FIG. 2 is a section through the stand at right angles to the roll axes.

The work rolls 25, 27 have driving spindles 25A, 27A by which the rolls are driven, the upright 12 having a central opening permitting the passage of the normal propeller shafts. Similarly, the crank shafts are driven through drive extensions 15C, 16C, the direction of rotation of the rolls 25, 27 and the crank shafts 15, 16 being shown by arrows in FIG. 2. The drives for the rolls 25, 27 and the crank shafts 15, 16 may be through gearboxes as described in the above numbered application and as illustrated in FIG. 2 or FIG. 3 of that application. The direction of movement of the work through the stand is indicated by arrow 31 in FIG. 2.

The hinge pins 33 between the roll mountings 21, 26 are not connected to the uprights 12, 13 and are therefore free to move relative to those uprights. As the crank shafts 15, 16 rotate, the bearing blocks 17A, 17B and 18A, 18B are given circular movements, as indicated at 40 in FIGS. 3A – D. FIGS. 3A – D demonstrate the movements of the upper roll 25 and the knuckle joints 33 at four different angular positions of crank shaft 15, spaced apart by 90°. The arrangement and movement of the lower roll 27 are effectively mirror images of those of roll 25 in the passline 42. By virtue of the eccentric movements of the bearing blocks 17 and 18 and the pivotal connection between the mountings, those mountings 21, 26 perform cyclic movements, during which the axes of the pivot pins 33 oscillate horizontally in the passline, again as shown in FIGS. 3A – D. The axes of the work rolls 25, 27 perform by virtue of the synchronous rotation of the crank shafts movements in closed paths 41, which resemble ovals or ellipses. In the arrangement illustrated, the major axes of the ellipses 41 along which the axes of the rolls move are inclined to the passline, the inclination of those axes to the passline 42 being determined by the angular position of the eccentrics for a given angular disposition of the roll mountings 21, 26 about the axis of the pivot pin 33.

Figure 3A:
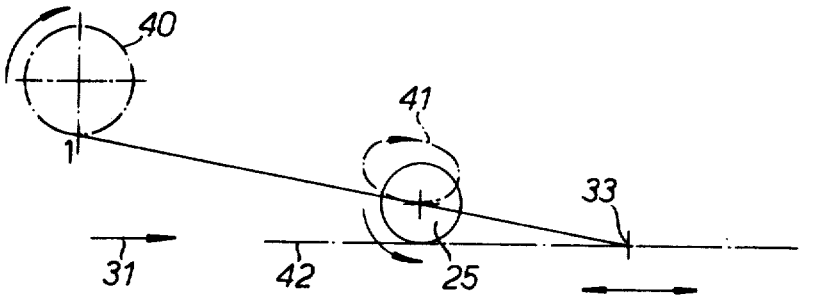
Figure 3B:
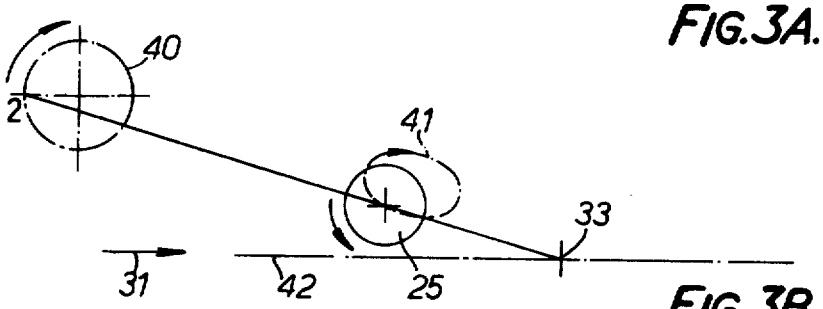
Figure 3C:
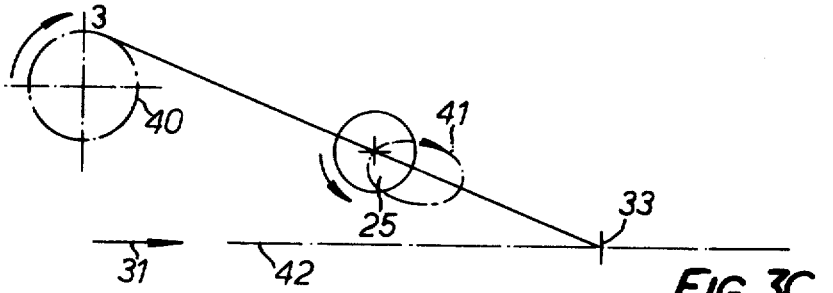
Figure 3D:
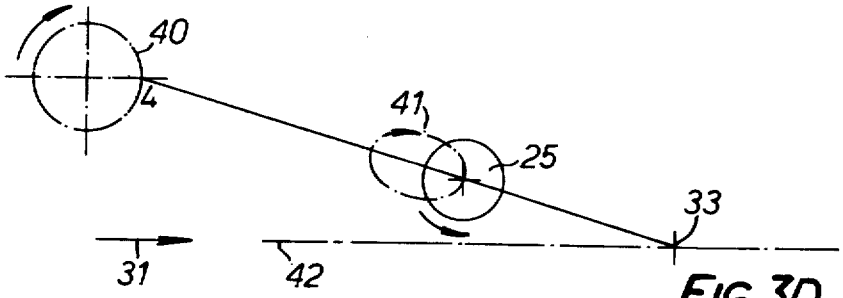

The work rolls 25, 27 thus execute movements similar to that described in the above numbered patent application, rolling over the work in the direction opposite the movement of the work and progressively approaching the passline to reduce the work (FIG. 3A); breaking contact with the work (FIGS. 3B and 3C); and returning to their starting positions (FIG. 3D). The drives for the rolls and the crank shafts are designed as described in the above-numbered application so that the speed of rotation of the rolls about their own axes is selected in relation to the speed of rotation of the crank shafts, such that the peripheral speed of the rolls due to their own drives exceeds their peripheral speed due to the eccentric drives, with the consequence that the work is urged through the stand, in the direction indicated.

The rolling load applied by the work to the work rolls 25, 27 is largely absorbed by the knuckle joints, and little is transmitted through the eccentrics to the housing formed by the uprights 12, 13. Consequently, the crank bearings are required to take little load and the eccentrics can thus be designed to give a larger throw than would otherwise be possible. In turn, this results in it being possible to have a large cyclic movement of the axes of the rolls 25, 27 and thus an extensive arc of contact between the work rolls and the work.

I claim:

1. A rod or bar mill stand for giving a primary reduction to a workpiece, comprising a pair of roll mountings;

a pair of co-operative work rolls each carried by a different roll mounting;

a pivotal connection between said mountings on one side of the plane through the axes of said work rolls, permitting relative pivoting of said mountings about an axis parallel to the roll axes;

for each said mounting, support means pivotally connected to a part of said mounting on the other side of said roll axes plane and including means for causing cyclic movement of said part;

whereby the axis of said work roll associated with the support means is constrained to move in a closed path which, over a limited part, approaches the passline of the stand, and means for driving said rolls about their axes.

2. A rod or bar mill stand as claimed in claim 1, in which each said support means comprises an eccentric mechanism, and which further includes means for driving said eccentric mechanisms in synchronism.

3. A rod or bar mill stand as claimed in claim 1, which includes a housing;

a pair of crank shafts journalled in said housing and each having at least one crank, said crank shafts being disposed parallel to said pivotal connection and on the side of said plane opposite to said pivotal connection, and means for rotating said cranks in synchronism.

4. A rod or bar mill stand according to claim 1, in which said pivotal connection comprises a pair of coaxial knuckle joints, each connected to both said mountings;

said knuckle joints lying substantially on said passline but spaced apart to permit passage of the work therebetween.

5. In a rod or bar mill stand for giving a primary reduction to a workpiece comprising a housing;

a pair of mountings swingingly supported by a housing on opposite sides of the passline;

a work roll carried by each mounting and designed to effect a first reduction of the workpiece to a rod or bar;

means for driving said mountings in a synchronous movement in which the work roll axes are constrained to move in closed paths which, over a limited part, approach the passline so that, in use, the rolls intermittently and simultaneously engage the workpiece on opposite sides, and means for driving each said work roll about its axis to give a peripheral speed differing from the peripheral speed of the roll surfaces due to said driving means for the mounting, such that the workpiece is urged in the feed direction;

the improvement in which said mountings are pivotally connected together, independently of said housing and on one side of the plane through the axes of said work rolls, to permit relative pivoting of said mountings about an axis parallel to said roll axes, and each said mounting is pivotally connected to said housing, on the other side of said plane, through said driving means for said mountings.

* * * * *